US010040607B2

(12) United States Patent
Roesler

(10) Patent No.: US 10,040,607 B2
(45) Date of Patent: Aug. 7, 2018

(54) PACKAGING SLEEVE WITH LATCHING CAP

(71) Applicant: Peter Roesler, Wangen (DE)

(72) Inventor: Peter Roesler, Wangen (DE)

(73) Assignee: Rose Plastic AG (DE)

( * ) Notice: Subject to any disclaimer, the term of this patent is extended or adjusted under 35 U.S.C. 154(b) by 0 days.

(21) Appl. No.: 14/487,661

(22) Filed: Sep. 16, 2014

(65) Prior Publication Data

US 2015/0076149 A1 Mar. 19, 2015

(30) Foreign Application Priority Data

Sep. 16, 2013 (DE) ..... 10 2013 015 271

(51) Int. Cl.

| | |
|---|---|
| ***B65D 21/08*** | (2006.01) |
| ***B65D 41/00*** | (2006.01) |
| ***B65D 25/14*** | (2006.01) |
| ***B65D 25/22*** | (2006.01) |
| ***B65D 43/02*** | (2006.01) |

(52) U.S. Cl.

CPC ..... *B65D 41/005* (2013.01); *B65D 21/086* (2013.01); *B65D 25/14* (2013.01); *B65D 25/22* (2013.01); *B65D 43/022* (2013.01); *B65D 2543/00092* (2013.01); *B65D 2543/00101* (2013.01); *B65D 2543/00111* (2013.01); *B65D 2543/00296* (2013.01)

(58) Field of Classification Search

CPC ..... B65D 21/086; B65D 85/20; B65D 85/26; B65D 43/0212; B65D 2543/00805; B65D 2543/00694; B65D 2543/00703; B65D 2543/00814; B65D 2543/00101; B65D 41/005; B65D 43/022; B65D 25/22; B65D 25/14; B65D 2543/00111; B65D 2543/00296; B65D 2543/00092

USPC ..... 220/212, 212.5, 916, 4.21, 4.24, 8, 220/784–786, 788, 751

See application file for complete search history.

(56) References Cited

U.S. PATENT DOCUMENTS

| | | | | |
|---|---|---|---|---|
| 1,450,674 | A * | 4/1923 | Marston | A45C 7/0031 131/242 |
| 3,023,925 | A * | 3/1962 | Sher | 220/786 |
| 3,240,384 | A * | 3/1966 | Lermer | 220/780 |
| 3,244,272 | A * | 4/1966 | Beaman | G07D 9/004 206/0.82 |
| 3,464,582 | A * | 9/1969 | Greitzer | B65D 43/0212 220/786 |
| 3,613,958 | A * | 10/1971 | Opp | 222/180 |
| 6,099,299 | A * | 8/2000 | Raymond et al. | 431/153 |
| 2006/0037882 | A1* | 2/2006 | Appelbaum et al. | 206/471 |
| 2010/0193533 | A1* | 8/2010 | Roesler | 220/780 |

(Continued)

FOREIGN PATENT DOCUMENTS

| | | | |
|---|---|---|---|
| DE | 2851096 | A * | 6/1980 |
| DE | 202011002261 | | 4/2011 |
| EP | 2848548 | | 3/2015 |

(Continued)

*Primary Examiner* — James N Smalley
(74) *Attorney, Agent, or Firm* — Cohen & Grigsby, P.C.

(57) ABSTRACT

A packaging sleeve (2) having at least one latching cap (1) arranged on the end. The shape of the latching cap is adapted according to the outer perimeter of the packaging sleeve (2) and securely attached to the packaging sleeve by its side walls (13) by a latching wall (15).

21 Claims, 6 Drawing Sheets

(56) References Cited

U.S. PATENT DOCUMENTS

| | | | | |
|---|---|---|---|---|
| 2011/0192746 | A1* | 8/2011 | Chang | 206/379 |
| 2013/0062234 | A1* | 3/2013 | Roesler | 206/349 |

FOREIGN PATENT DOCUMENTS

| | | | |
|---|---|---|---|
| JP | H11321868 | | 11/1999 |
| WO | WO 2011127597 | A1 * | 10/2011 |

* cited by examiner

PACKAGING SLEEVE WITH LATCHING CAP

The Applicant claims priority for this application to DE 102013015271.2 filed in Germany on Sep. 16, 2013.

BACKGROUND OF THE INVENTION

Field of the Invention

The invention relates to a packaging sleeve with a latching cap and a latching cap that can be used for a packaging sleeve and can also be used as a snap-on hanger.

Snap-on hangers of a general type are known. They consist essentially of a leaf-shaped, planar, approximately tabular part, that has snap teeth or snap hooks on its underside. The snap teeth or snap hooks are suitable for engaging in and being attached by latching to a respective recess in the cover surface of a packaging sleeve or other packaging.

One disadvantage of the known latching hangers is that a recess or a hole is always required on the side of the packaging to engage and latch the snap hook in the hole.

However, packaging having a hole is not desirable in various cases because the contents of the packaging sleeve might be damaged or lost, for example, and such holes allow dirt and moisture to penetrate into the package.

Another disadvantage of the known latching connection is its low retaining force, which is created through only two barbed hook-type snap hooks. Furthermore, the latching connection is restricted or is no longer possible if the barbed hooks are damaged in the process of joining the snap hook to the packaging sleeve.

Furthermore, the load-bearing capacity of the barbed hooks is limited. The barbed hooks may fail when high loads are stored in the packaging sleeve.

When a packaging sleeve is manufactured by the blow molding method, creating a recess in the cover region of the packaging sleeve is costly because additional tools are required.

SUMMARY OF THE INVENTION

One object of the present invention is therefore to provide a packaging sleeve having a snap-on hanger or, more generally, with a latching cap such that there is secure seating between the latching cap and the packaging sleeve, and the need for a recess in the region of the packaging sleeve is avoided.

To overcome such difficulties, the presently disclosed invention may include a packaging sleeve with at least one latching cap arranged on the end of the packaging sleeve. The shape of the latching cap is adapted to the shape of the outer circumference or perimeter of the packaging sleeve. The latching cap is attached to the packaging sleeve by the side walls of the latching cap which are latched to the packaging sleeve at its outer perimeter or circumference.

In an embodiment of the invention, the shape of the latching cap is adapted to the outside circumference or perimeter of the packaging sleeve, and the latching cap is attached as a plug-on part with side walls that are secured to the outside circumference of the packaging sleeve by latching.

An advantage of the presently disclosed invention is that the latching cap avoids the requirement of a central hole or a recess in the cover region of the packaging sleeve. The latching cap according to the presently disclosed invention, which can also be used as a hanger, extends radially and laterally beyond the outside circumference of the packaging sleeve, at least in the front-end region, where it cooperates with respective latching protrusions on the outside circumference or surface of the packaging sleeve in a latching manner.

In a preferred embodiment of the invention, the packaging sleeve has protrusions in its front-end region that pass through respective latching recesses in the region of the latching cap. The actual latching is accomplished through latching edges in the region of the latching recesses of the latching cap. The latching edges are in contact with the lower side or relief area of the latching protrusions on the packaging sleeve.

In a preferred embodiment of the invention, at least two diametrically opposed latching recesses arranged in corner regions of the latching cap are provided. The latching edges that extend beyond the respective protrusions on the packaging sleeve are provided on the extended end of the latching recess, wherein the latching edges are in contact with the packaging sleeve in a secured position in a relief area beneath these protrusions.

Thus, a latching engagement on the outside circumference of a packaging sleeve is arranged on at least two diametrically opposed sides of a latching cap.

In a preferred embodiment of the present invention, it is provided that, on the whole, four latch recesses are arranged in the region of the latching cap, so that two latching recesses are diametrically opposite one another and there are a total of four latching recesses. It is also preferable that the packaging sleeve also has four protrusions that are arranged in the corner regions and are gripped from beneath in a relief area and held by the latching edge on the side of the latching cap.

The number of latching recesses and the respective latching protrusions on the packaging side depends on the profile of the package. If a package sleeve having three corners is used, then only three latching protrusions that cooperate with the respective latching recesses on the side of the hanger are used.

To create the latching connection between the latching cap and the packaging sleeve in the region of the corner protrusions, it is preferable that the latching cap has elastic resiliency and extensibility in its lower side wall region.

It is advantageous that the latching recesses in the corner region of the latching cap have a large volume so the result is a resilient latching wall having a particularly small area because of the reduced material there relative to the remaining surface region of the corner wall. In this way, the resilient latching wall can be easily widened elastically to yield the latching effect for the latching edge connected thereto.

The invention is not limited to the fact that the latching recesses are provided in the corner region of the latching cap. In another embodiment of the invention, the latching recesses may be arranged in the region of the side wall of the latching cap on the opposing side walls and away from the corner region. However, the resilient latching wall that then results in the region of the side wall extends only over the side wall and does not have as much elastic expansion or spring capacity as compared to, for example, the embodiment of the latching recesses in the region of the corners of the latching cap as may be provided in alternative embodiments.

As used herein, the term "latching cap" is used in the general sense because various functions can be assigned to such a latching cap.

In another embodiment, the latching cap may be designed as a hanger. In that case a hanging strap that includes a conventional hanging opening is integrally molded on the cover wall of the latching cap.

Instead of a single hanging strap, a plurality of hanging straps in various forms may also be integrally attached to the cover wall of the latching cap. In this case the latching cap is designed as a latching hanger.

However, in another embodiment of the invention, the hanging strap may be omitted and the latching cap may be snapped onto the packaging sleeve as a snap-on cover. In that case, the end bottom walls of the packaging sleeve are omitted and the snap-on latching cap forms the snap-on closure for the front end of the packaging sleeve.

Other embodiments are not limited to the packaging sleeve being connected releasably to the latching cap. In another embodiment, the latching cap may be snapped onto one side as well as the other side of the packaging sleeve.

If a packaging sleeve having any cross section and any profile is used, then it is preferable that the packaging sleeve consists of two parts that may be inserted one into the other and may be locked together. This embodiment is herein later referred to as the inner sleeve and the outer sleeve.

However, the disclosed invention is not limited to this. The disclosed invention relates to any packaging sleeve having any cross section shape, such that the latching cap can be locked releasably onto the end side or the end wall of the packaging sleeve, extending around the outside circumference of the packaging sleeve.

The latching cap may also serve as a bottom-side reinforcement for the bottom wall of the packaging sleeve.

When the packaging sleeve includes two sleeves, one of which can be inserted into the other, it is preferred that only a single latching cap with a single shape may be used for the outer sleeve, which has a larger outside diameter in comparison to the smaller outside diameter of the inner sleeve. The latching cap is so elastic that it is elastically in contact with the larger outer sleeve and forms an elastic latching connection there, but is also in contact with the smaller inner circumference of the inner sleeve and also forms a latching connection there.

In another embodiment, the protrusions on the end faces that are assigned to the inner and outer sleeves may be designed with the same dimensions, so that adjustment of the different diameters of the latching cap is unnecessary.

The subject matter of the presently disclosed invention is derived not only from the subject matter of the individual patent claims but also from the combination of the individual patent claims with one another.

All the information and features disclosed in the documents, including the abstract, and in particular the three-dimensional embodiment depicted in the drawings are disclosure of the invention insofar as they are novel individually or in any combination in comparison with the prior art.

BRIEF DESCRIPTION OF THE DRAWINGS

The invention is explained in greater detail below on the basis of drawings which illustrate one preferred embodiment. Additional features of the disclosed invention and advantages of the disclosed invention can be derived from these drawings and the description thereof.

They show.

DESCRIPTION OF A PRESENTLY PREFERRED EMBODIMENT

Figure 1:
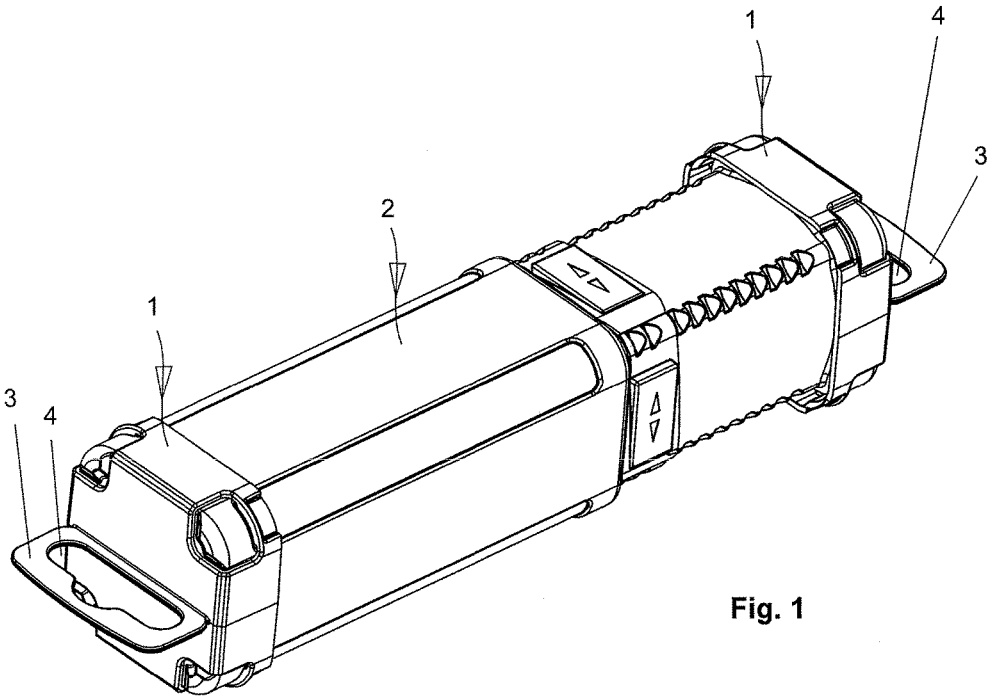
FIG. 1: a perspective diagram of a packaging sleeve having two snap-on hangers on opposite ends

FIG. 1 shows in general a packaging sleeve 2 consisting of two parts that can be inserted one into the other and can be locked together. An outer sleeve 7 (see FIG. 2) is designed to be displaceable and lockable by means of an inner sleeve 6, so that the length of the packaging sleeve 2 is thereby continuously adjustable and lockable.

A latching cap 1 designed as a hanger is snapped onto the respective end side of the packaging sleeve 2. In the embodiment as a hanger, the latching cap 1 has a hanging strap 3 with a conventional hanger opening 4 formed in it.

Figure 3:
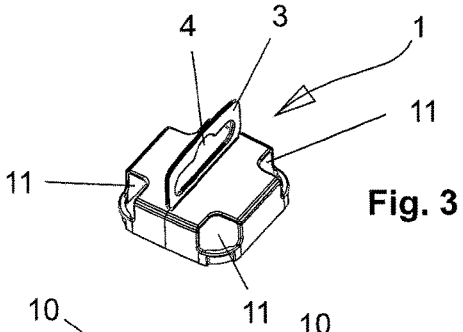
FIG. 3: a perspective diagram of a latching hanger
Figure 2:
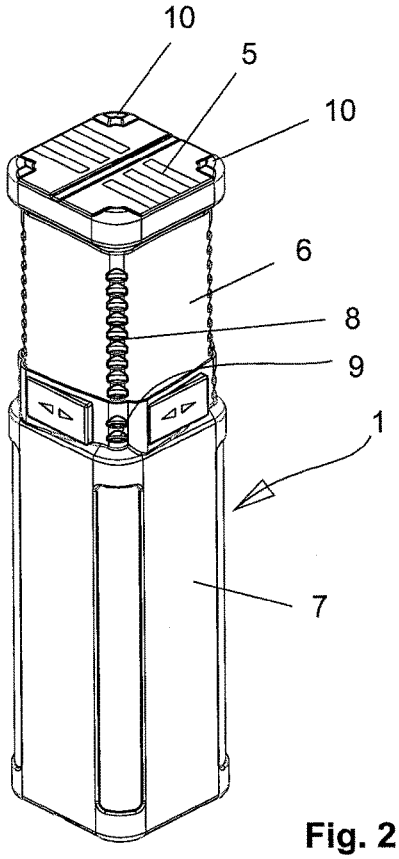
FIG. 2: the packaging sleeve according to FIG. 1 with the hanger removed

FIG. 2 shows that the packaging sleeve 2 has a bottom wall 5 on both the inner sleeve 6 and the outer sleeve 7, so that the latching cap 1 according to FIG. 3 can be snapped onto it.

Figure 4:
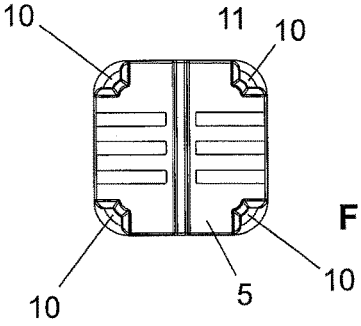
FIG. 4: a top view of the bottom side of the packaging sleeve according to FIG. 2

For this purpose, protrusions 10 which engage in the respective latching recesses 11 of the latching cap 1 according to FIG. 3 and are locked in place there are formed by the inner sleeve 6 and the outer sleeve 7 in the corners in the region of the respective bottom wall 5. The top view of the bottom wall 5 is shown in FIG. 4.

Figure 5:
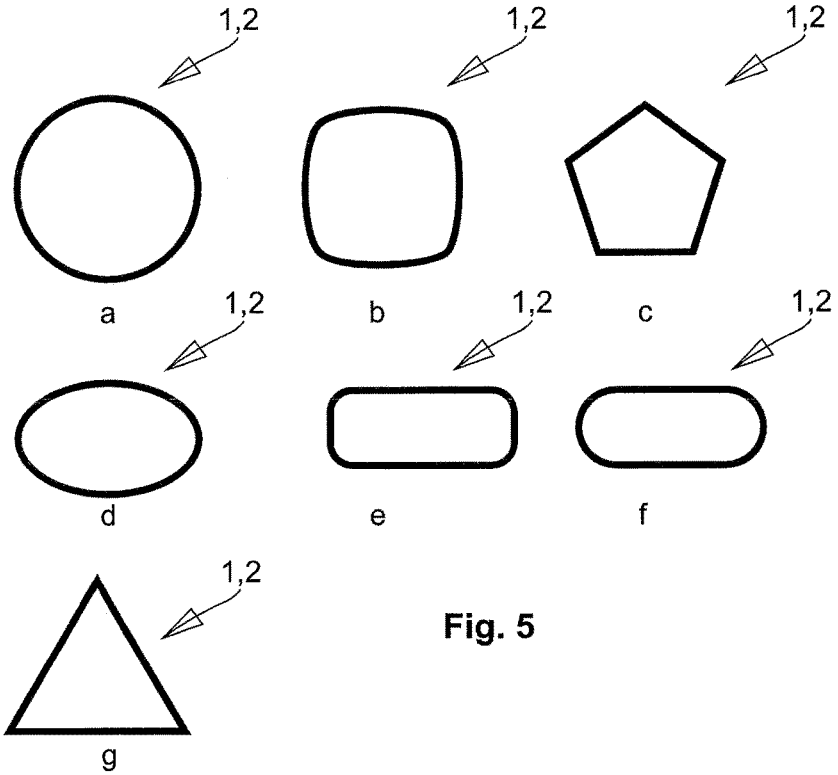
FIGS. 5*a-g*: various profile shapes of packaging sleeves and latching caps adapted thereto

FIG. 5 (illustrations a-g) shows that the packaging sleeve 2 may have any cross section according to the diagrams in a-g and therefore the latching cap 1 may have a profile shape adapted thereto.

Likewise, the invention is not limited to a packaging sleeve 2 that is variable in length and can be locked. Only the exemplary embodiment according to FIG. 2 shows that there is a latching path 8 consisting of a plurality of teeth in the region of the corners of the inner sleeve 6, cooperating with the respective snap teeth 9 directed radially inward on the inner circumference of the outer sleeve 7. Such a type of latching is described in DE 28 51 096 C2. In this way the inner sleeve 6 can be inserted continuously into the outer sleeve 7 and locked in position by the latching engagement between the teeth of the latching path 8 and the snap teeth 9 of the outer sleeve 7.

The disclosed invention is not limited to this embodiment, as already indicated. Packaging sleeves of any cross-sectional shape according to FIG. 5 may be used.

Figure 6:
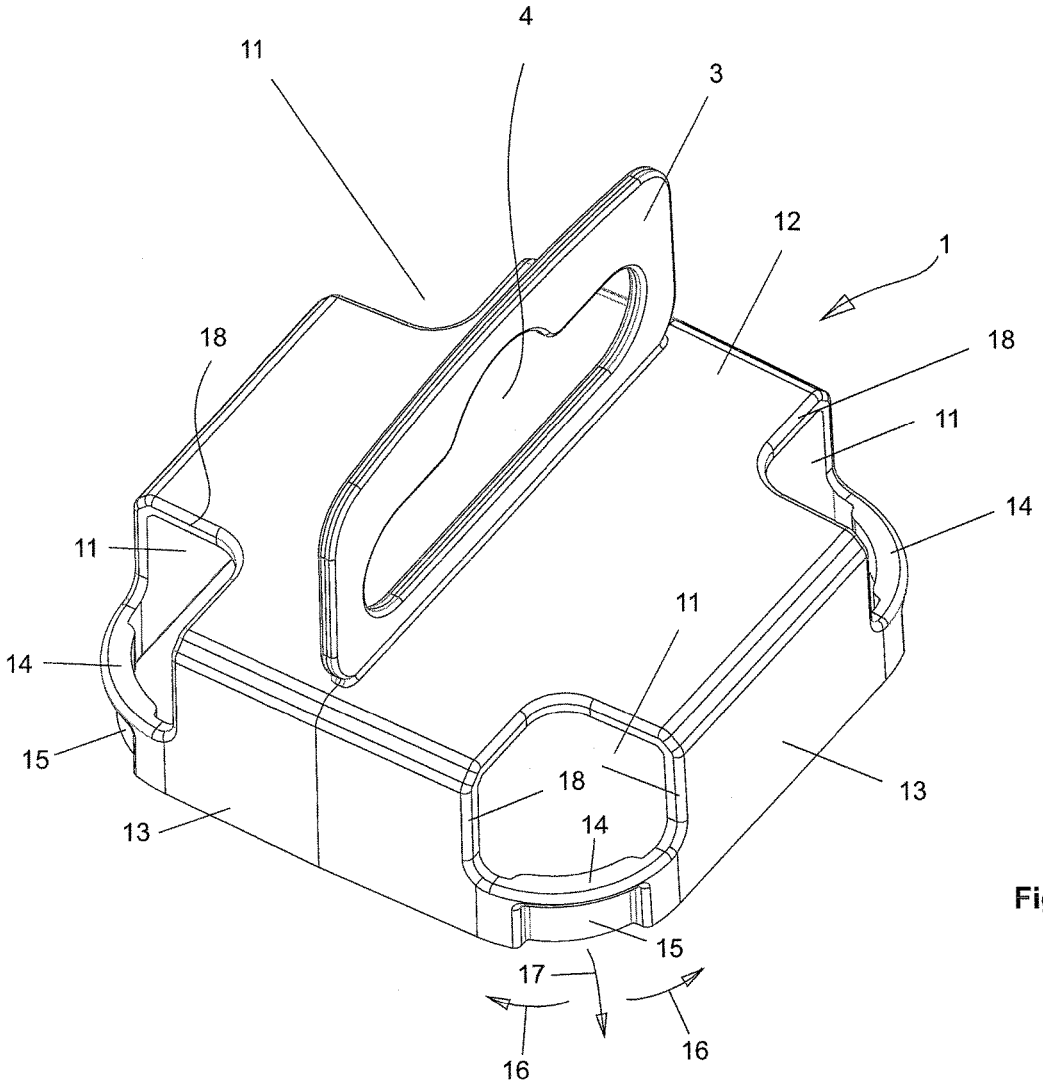
FIG. 6: a perspective diagram of the latching cap
Figure 7:
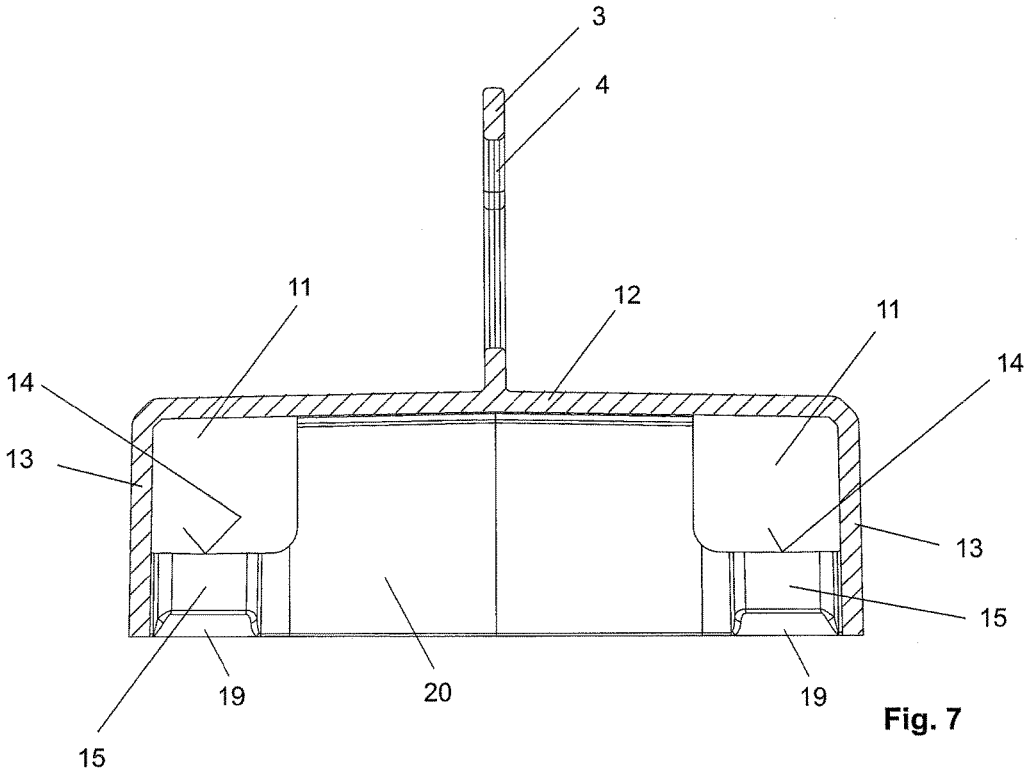
FIG. 7: a section through the latching cap according to FIG. 6 across the plane of the hanging strap

However, if the latching cap is used as a closure element, then according to FIG. 6 the hanging strap 3 is omitted and the cover wall 12 of the latching cap 1 then serves as a closure for the end faces of the packaging sleeve 2.

Likewise, it may happen that the hanging strap 3 remains on the cover wall 12 but the latter nevertheless serves as a closure element for the open end faces of the packaging sleeve 2.

The latching cap 1 is preferably manufactured as an injection molded plastic part and has side walls 13 extending away from and orthogonally to the cover wall 12, such that latching recesses 11, which are bordered by the peripheral edges 18, are provided in the corner regions of the side walls 13.

To reinforce the flexural stiffness of the cover wall 12 of the latching cap an insertion part such as a metal plate or a plastic sheet may be inserted from the inside. Such an embodiment is expedient when particularly heavy objects (for example, a drill bit) are placed in the interior of the packaging sleeve, such that the tip is directed toward the end wall of the packaging sleeve and are thus directed against the reinforced cover wall 12 of the latching cap 1.

A latching edge 14 which is integrally molded above a resilient latching wall 15 in one piece with the material is formed in the lower region of the bordering edge 18.

In attaching the latching cap 1 to the respective protrusions 10 of the packaging sleeve 2, the protrusions 10 first engage in the receptacle space 20 of the latching cap 1 and widen the latching wall 15 resiliently outward in the direction of the arrow 16 in the circumferential direction and also in the direction of the arrow 17 in the radial direction. After the protrusions 10 of the packaging sleeve 2 have overcome the resilient latching wall 15 so that the protrusions 10 fully enter the latching recess 11, latching wall 15 it snaps back again, so that the latching edge 14 is then in contact with the underside of the protrusions 10 and thus establishes a locking position.

Figure 8:
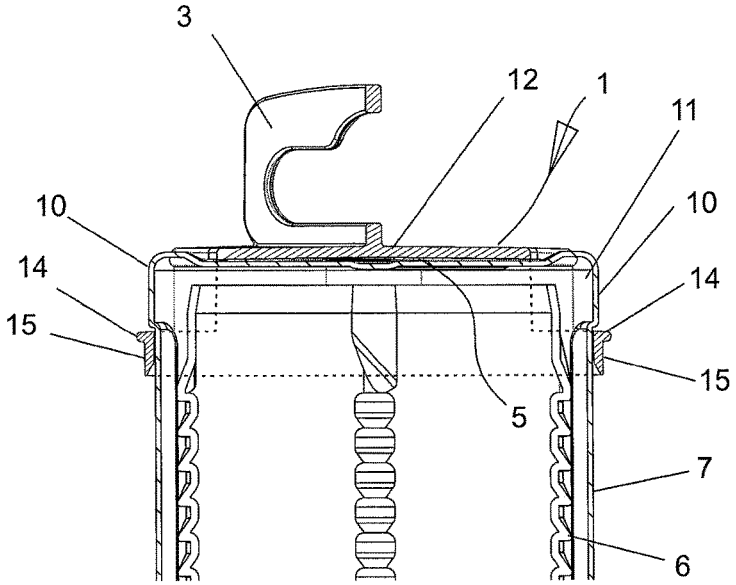
FIG. 8: a diagonal section through the latching cap and the top side of the outer sleeve
Figure 9:
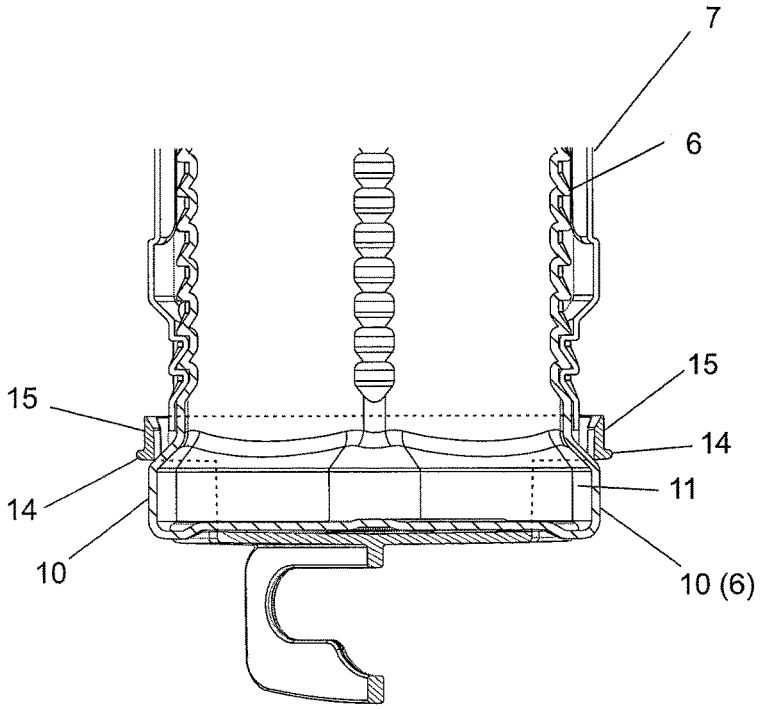
FIG. 9: the same section as FIG. 8, with a section cut through the inner sleeve

These relationships are illustrated in FIGS. 8 and 9. It can be seen here that the latching edge 14 of the latching cap 1 is in contact with the underside of the respective protrusion 10 of the packaging sleeve 2. FIG. 8 shows that the protrusions 10 are arranged in the region of the outer sleeve 7, while FIG. 9 shows that the protrusions 10 are arranged in the region of the inner sleeve 6 with the same diameter and the same dimensions.

An insertion bevel 19 may also be provided in the region of the latching wall 15 to bring the obliquely shaped protrusions 10 easily into the latching recess 11 of the latching cap 1 while overcoming the latching wall 15 resiliently.

Figure 10:
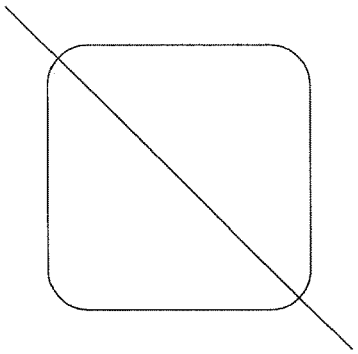
FIG. 10: a schematic diagram of the section guidance for the sections according to FIGS. 8 and 9
Figure 11:
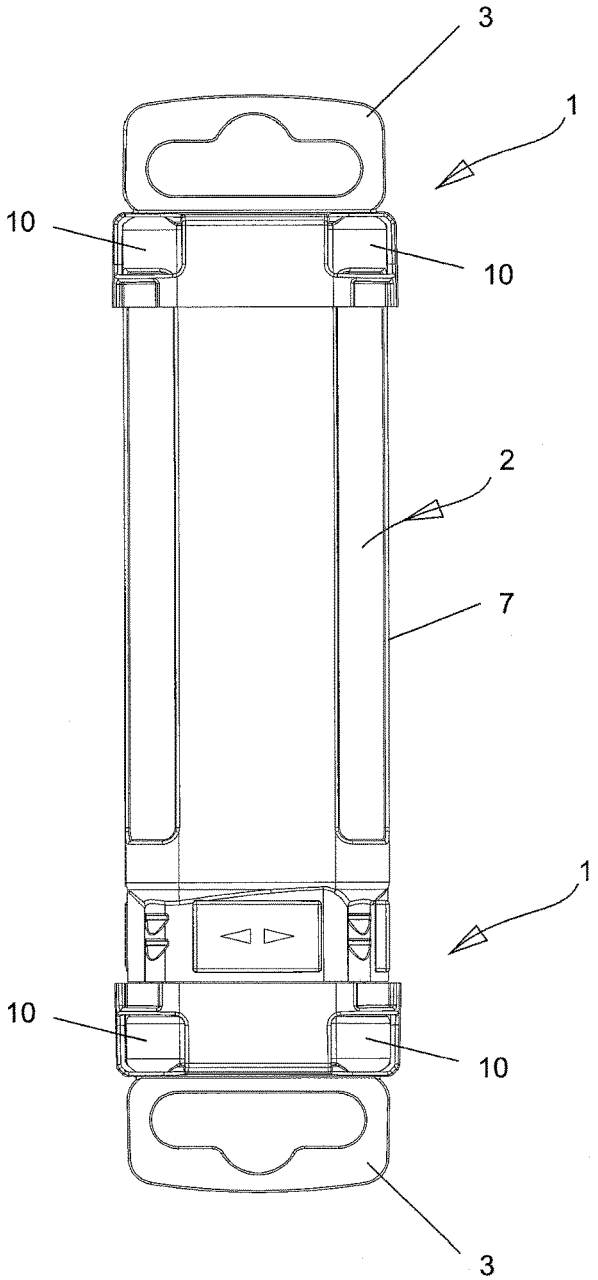
FIG. 11: a side view of the packaging sleeve having snap-on latching caps

FIG. 10 shows the diagonal section used to create the drawings according to FIGS. 8 and 9, and FIG. 11 shows a side view of a packaging sleeve 2 provided with two oppositely arranged latching caps 1.

The disclosed invention includes the latching cap together with and separately from the packaging sleeve.

LEGEND TO THE DRAWINGS

1 Latching cap
2 Packaging sleeve
3 Hanging strap
4 Hanger opening
5 Bottom wall
6 Inner sleeve
7 Outer sleeve
8 Latching path
9 Snap teeth
10 Protrusion
11 Latching recess
12 Cover wall
13 Side wall
14 Latching edge
15 Latching wall (resilient)
16 Direction of arrow
17 Direction of arrow
18 Bordering edge
19 Insertion bevel
20 Receptacle space

What is claimed is:

1. A packaging sleeve comprising:

at least one sleeve having an outer surface that defines an outer perimeter of said sleeve, said sleeve also having an inner surface that at least partially defines a storage chamber, an edge of said outer surface cooperating with an edge of said inner surface to define an end of said sleeve, a portion of said outer surface having protrusions that extend radially outward and define an underside or relief portion thereon; and at least one latching cap that is secured to an end of said sleeve, said latching cap having a cover wall and side walls that are connected to said cover wall and extend away from said cover wall to form a terminal edge, said side walls being arranged in correspondence with the outer perimeter of the outer surface of said sleeve, said outwardly extending protrusions of said sleeve being adjacent one end of said sleeve, said side walls of said latching cap extending radially and laterally beyond the outer perimeter of said sleeve and beyond the outwardly extending protrusions as said latching cap is secured to said end of said sleeve, the side walls of said latching cap having latching edges that define latching recesses, each of said protrusions extending through a respective latching recess with said latching edge being elastically expandable and resilient so as to be in spring contact with the relief portion or underside of a respective one of said protrusions at times when said latching cap is secured to said end of said sleeve, each of said side walls having a latching wall in the lower region of said side wall, said latching wall extending between one of said latching edges and the terminal edge of said side wall, said latching wall having a smaller cross-section than the cross-section of adjacent portions of said side wall such that said latching wall is elastically expandable and resilient such that the lower region of said side wall is expandable over said radially outwardly extending protrusion to release said latching cap from said secured position.

2. The packaging sleeve according to claim 1 wherein said latching cap has a perimeter that defines at least two corner regions, each of said corner regions having a latching recess arranged therein, said latching recesses being diametrically opposed to each other, the latching edges of said latching recesses being integrally molded in said cap as a lower end of the respective latching recess and extending beneath the respective protrusion such that said latching edges are in spring contact beneath the protrusions to secure said latching cap to said sleeve.

3. The packaging sleeve according to claim 2 wherein said outer surface of said sleeve has four protrusions that are arranged in respective corner regions of said outer surface, said packaging sleeve having four latching recesses that are arranged in respective corner regions of the latching cap, said latching edges in each of said latching recesses extending beneath one of said protrusions to hold the protrusion to the latching cap.

4. The packaging sleeve according to claim 1 wherein the latching cap is composed of a material having elastic resilience such that the lower region of the side walls can be expanded over the perimeter of the sleeve.

5. The packaging sleeve according to claim 1 wherein said latching cap has a perimeter that defines a corner region, said latching recesses being located outside of the corner region and in a region of the opposing side walls of the latching cap.

6. The packaging sleeve according to claim 1 wherein the profile shape of the sleeve is selected from the group comprising square, rectangular, round, triangular, diamond and trapezoidal shapes and wherein the perimeter shape of the latching cap corresponds to the profile shape of the sleeve.

7. The packaging sleeve according to claim 1 wherein said cover wall of said latching cap includes an insertion part that reinforces said cover wall.

8. The packaging sleeve according to claim 1 wherein the latching cap is a closure cover that seals an open end of the sleeve.

9. The packaging sleeve according to claim 1 wherein the latching cap includes a hanger.

10. A latching cap for a packaging sleeve according to claim 1 wherein the side walls of the latching cap are attached in a locking manner to the outer surface of the sleeve.

11. A packaging sleeve comprising:

an outer sleeve with an outer surface that defines an outer perimeter of said outer sleeve, said outer sleeve also having an inner surface, an edge of said outer surface cooperating with an edge of said inner surface to define a first end of said outer sleeve, said outer sleeve having a second end that includes a bottom wall, a portion of the outer surface of said outer sleeve having protrusions that are adjacent to said second end of said outer sleeve and that extend radially outward and define an underside or relief portion thereon;

an inner sleeve having an outer surface that defines an outer perimeter of said inner sleeve, said inner sleeve also having an inner surface, an edge of said outer surface cooperating with an edge of said inner surface to define a first end of said inner sleeve, said inner sleeve having a second end that includes a bottom wall, a portion of the outer surface of said inner sleeve having protrusions that are adjacent said second end of said outer sleeve and that extend radially outward and define an underside or relief portion thereon, said first end of said inner sleeve being insertable into the first end of said outer sleeve such that the inner surface of said outer sleeve cooperates with the inner surface of said inner sleeve to define a storage chamber; and at least one latching cap that can be secured to the second end of said outer sleeve and to the second end of said inner sleeve, said latching cap having side walls that are arranged in correspondence with the outer perimeter of the outer surface of said outer sleeve and in correspondence with the outer perimeter of the outer surface of said inner sleeve, said side walls of said latching cap extending radially and laterally beyond the outer perimeter of said outer sleeve and beyond the outwardly extending protrusions of said outer sleeve as said latching cap is secured to the second end of said outer sleeve, the side walls of said latching cap also extending radially and laterally beyond the outer perimeter of said inner sleeve and beyond the outwardly extending protrusions of said inner sleeve as said latching cap is secured to the second end of said inner sleeve, the side walls of said latching cap defining latching recesses, each of said latching recesses further defining a latching edge, each of said protrusions extending through a respective latching recess with said latching edge being elastically expandable and resilient so as to be in spring contact with the relief portion or underside of a respective one of said protrusions at times when said latching cap is secured to second end of said outer sleeve or to the second end of said inner sleeve, said side walls having a lower region that is elastically expandable and resilient such that the lower region of said side walls is expandable over said radially outwardly extending protrusions of said outer sleeve to release said latching cap from said secured position at the second end of said outer sleeve, and is also expandable over said radially outwardly extending protrusions of said inner sleeve to release said latching cap from said secured position at the second end of inner sleeve.

12. The packaging sleeve according to claim 11 wherein said latching cap has a perimeter that defines at least two corner regions, each of said corner regions having a latching recess arranged therein, said latching recesses being diametrically opposed to each other, the latching edges of said latching recesses being integrally molded in said cap as a lower end of the respective latching recess and extending beneath the respective protrusion such that said latching edges are in spring contact beneath the protrusions to secure said latching cap to said outer sleeve or to said inner sleeve.

13. The packaging sleeve according to claim 12 wherein said outer surface of said outer sleeve has four protrusions that are arranged in respective corner regions of said outer surface of said outer sleeve and wherein said outer surface of said inner sleeve has four protrusions that are arranged in respective corner regions of said outer surface of said inner sleeve, said packaging sleeve having four latching recesses that are arranged in respective corner regions of the latching cap, said latching edges in each of said latching recesses extending beneath one of said protrusions of said outer sleeve or said inner sleeve to hold the protrusion to the latching cap.

14. The packaging sleeve according to claim 11 wherein the latching cap is composed of a material having elastic resilience such that the lower region of the side walls is expandable over the perimeter of the outer sleeve and over the perimeter of the inner sleeve.

15. The packaging sleeve according to claim 11 wherein a latching wall defines a respective one of said latching edges and wherein said latching wall has a cross section that is smaller than the cross section of other portions of said side walls of said latching cap such that said latching wall is resilient and elastically expandable so as to yield the latching effect for the latching edge.

16. The packaging sleeve according to claim 11 wherein said latching cap has a perimeter that defines a corner region, said latching recesses being located outside of the corner region and in a region of the opposing side walls of the latching cap.

17. The packaging sleeve according to claim 11 wherein the profile shape of the outer sleeve and the profile shape of the inner sleeve is selected from the group comprising square, rectangular, round, triangular, diamond and trapezoidal shapes and wherein the perimeter shape of the latching cap corresponds to the profile shape of the outer sleeve and the profile shape of the inner sleeve.

18. The packaging sleeve according to claim 11 wherein said latching cap includes a cover wall, said cover wall including an insertion part that reinforces said cover wall.

19. The packaging sleeve according to claim 11 wherein the latching cap is a closure cover that is operative to seal an open end of the outer sleeve and an open end of the inner sleeve.

20. The packaging sleeve according to claim 11 wherein the latching cap includes a hanger.

21. A latching cap for a packaging sleeve according to claim 11 wherein the side walls of the latching cap are attached in a locking manner to the outer surface of the outer sleeve and to the outer surface of the inner sleeve.

* * * * *